US007670114B2

(12) United States Patent
McCallum et al.

(10) Patent No.: US 7,670,114 B2
(45) Date of Patent: Mar. 2, 2010

(54) INDUSTRIAL FAN

(75) Inventors: Jonathan E. McCallum, Edmonton (CA); Kevin J. Dewar, Edmonton (CA)

(73) Assignee: Flexxaire Manufacturing Inc., Edmonton (CA)

( * ) Notice: Subject to any disclaimer, the term of this patent is extended or adjusted under 35 U.S.C. 154(b) by 832 days.

(21) Appl. No.: 11/154,270

(22) Filed: Jun. 16, 2005

(65) Prior Publication Data

US 2006/0280608 A1 Dec. 14, 2006

(30) Foreign Application Priority Data

Jun. 10, 2005 (CA) ..... 2510157

(51) Int. Cl.
*F04D 29/36* (2006.01)

(52) U.S. Cl. ..... 416/153; 416/61; 416/248

(58) Field of Classification Search ..... 416/153, 416/155, 163, 164, 167, 242, 243, 248, 61
See application file for complete search history.

(56) References Cited

U.S. PATENT DOCUMENTS

| | | | | |
|---|---|---|---|---|
| 1,368,808 | A | 2/1921 | Koenig | |
| 1,635,315 | A | 7/1927 | Ehinger | |
| 1,650,776 | A | 11/1927 | Stock | |
| 2,613,752 | A | 10/1952 | Hawkins | |
| 2,812,027 | A | 11/1957 | Swan | |
| 2,844,303 | A * | 7/1958 | Kristiansen | 416/52 |
| 2,850,106 | A | 9/1958 | Swan | |
| 2,974,728 | A * | 3/1961 | Culp | 416/239 |
| 3,026,943 | A | 3/1962 | Huber | |
| 3,853,427 | A * | 12/1974 | Holt | 416/167 |
| 3,967,916 | A * | 7/1976 | Chittom | 416/167 |
| 4,140,435 | A | 2/1979 | Huber | |
| 4,565,494 | A | 1/1986 | Dinger | |
| 4,606,702 | A | 8/1986 | Dinger | |
| 4,610,600 | A | 9/1986 | Bleier | |
| 5,022,821 | A * | 6/1991 | Isert | 416/167 |
| 5,122,034 | A | 6/1992 | Isert | |
| 5,211,539 | A | 5/1993 | McCarty | |
| 5,464,324 | A | 11/1995 | Langenberg | |
| 6,190,126 | B1 | 2/2001 | Haegele et al. | |
| 6,213,713 | B1 * | 4/2001 | Dickmann | 416/61 |
| 2004/0067135 | A1 | 4/2004 | McCallum et al. | |

FOREIGN PATENT DOCUMENTS

| | | |
|---|---|---|
| CA | 2403632 | 3/2004 |

* cited by examiner

*Primary Examiner*—Ninh H Nguyen
(74) *Attorney, Agent, or Firm*—Christensen O'Connor Johnson Kindness PLLC

(57) ABSTRACT

An engine fan has fan blades capable of switching between a sucking and blowing operation when the fan is not in operation. An internal mechanism allows for blade pitch adjustment of all fan blades by twisting one blade about its own axis. End positions of the blade rotation may be held by forces generated by the rotating blades or held by a locking mechanism.

26 Claims, 8 Drawing Sheets

INDUSTRIAL FAN

BACKGROUND OF THE INVENTION

A reversible fan is known in which individual fan blades are rotatable manually to place the fan blades into either reverse or normal thrust positions. Such a fan is available from Huber Reversible Fan Inc. of Pennsylvania, United States, and also described in U.S. Pat. No. 4,606,702. Such fans are used on a wide variety of industrial equipment and vehicles that have engines.

The inventors have identified a need for a reversible fan in which rotation of one fan blade rotates all the fan blades.

SUMMARY OF THE INVENTION

Therefore, according to an aspect of the invention, there is provided a variable or reversible pitch fan in which an internal mechanism provides simultaneous manual blade pitch adjustment of all fan blades. Manual actuation of the internal mechanism such as by twisting one blade about its own axis rotates all fan blades. In a further aspect of the invention, a sensor provides an indication of when the blades are in the intended position, such as a normal operation position and a reverse operating position. In one embodiment, the blades are held in their respective end positions of rotation by forces generated by the rotating blades in use. In another embodiment, a lock holds the blades in their respective end positions of rotation.

These and other aspects of the invention are set out in the claims, which are incorporated here by reference.

BRIEF DESCRIPTION OF THE FIGURES

Preferred embodiments of the invention will now be described with reference to the figures, in which like reference characters denote like elements, by way of example, and in which.

DETAILED DESCRIPTION OF PREFERRED EMBODIMENTS

In the claims, the word "comprising" is used in its inclusive sense and does not exclude other elements being present. The indefinite article "a" before a claim feature does not exclude more than one of the feature being present. A fan blade is in the feathered position when the chord of the fan blade lies parallel to the direction of air flow through the fan. A fan blade is in the neutral position when the chord of a fan blade lies perpendicular to the direction of air flow. A reversible or variable pitch fan is an operational reversible or variable pitch fan, which for example requires that the parts are made of materials suitable for the intended application. In a manually actuated reversible or variable pitch fan, the fan blades remain in the normal or reverse position, as the case may be, during operation until changed by the operator.

Figure 1:
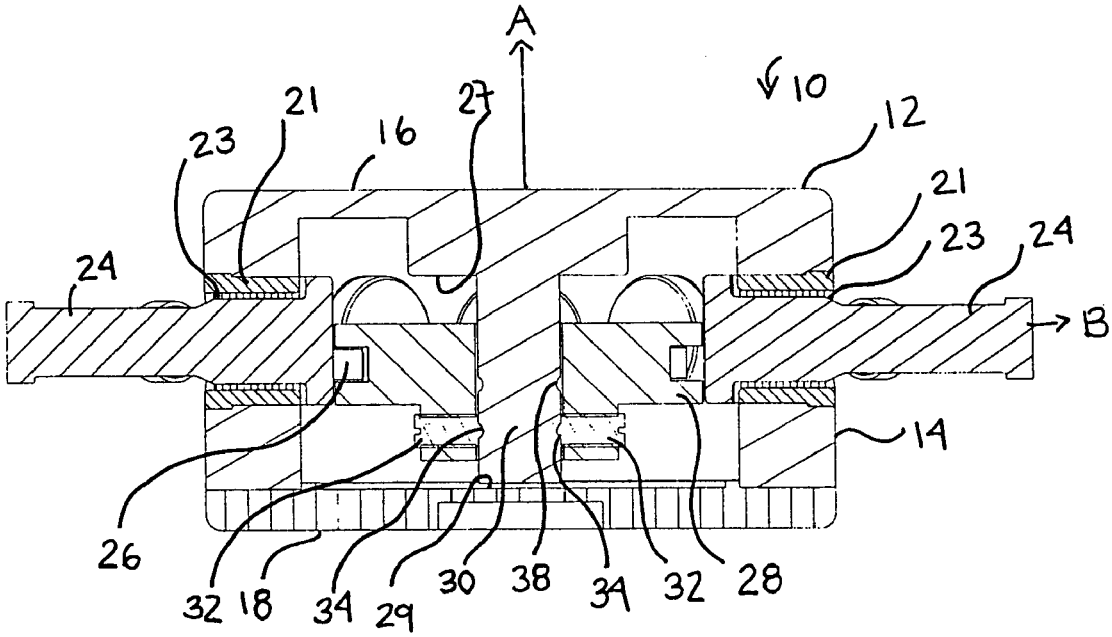
FIG. 1 is a cross-section through a variable pitch fan according to a first embodiment of the invention, with the fan blades in a normal thrust position, corresponding typically to sucking of air through a radiator of an engine.
Figure 2:
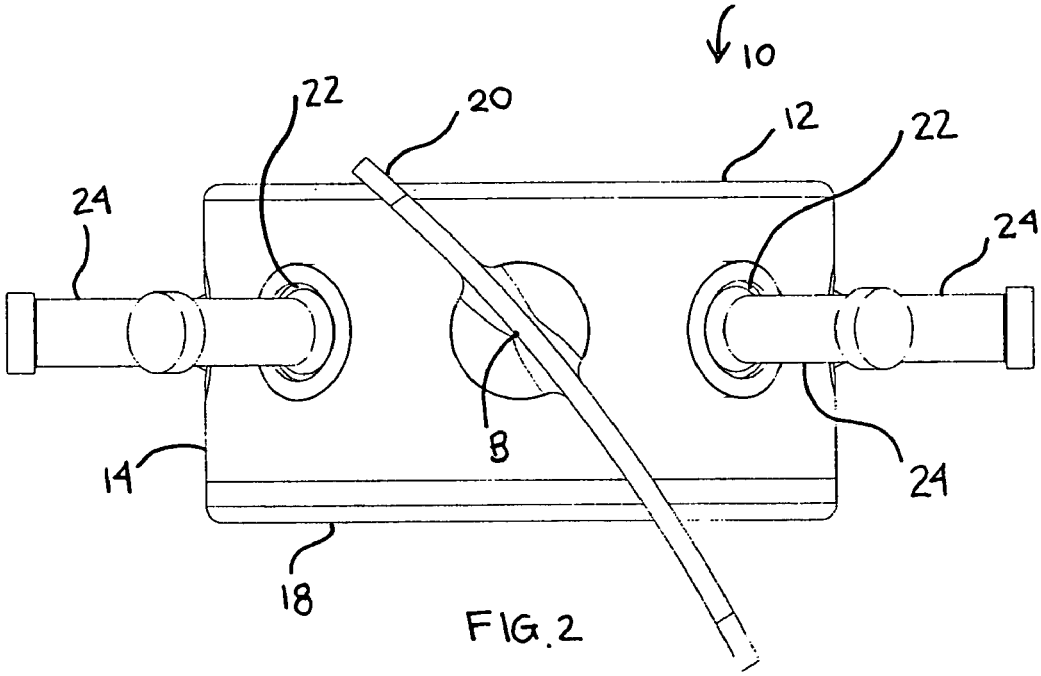
FIG. 2 is a side-view of the variable pitch fan of FIG. 1 with the blades in the normal thrust position.
Figure 3:
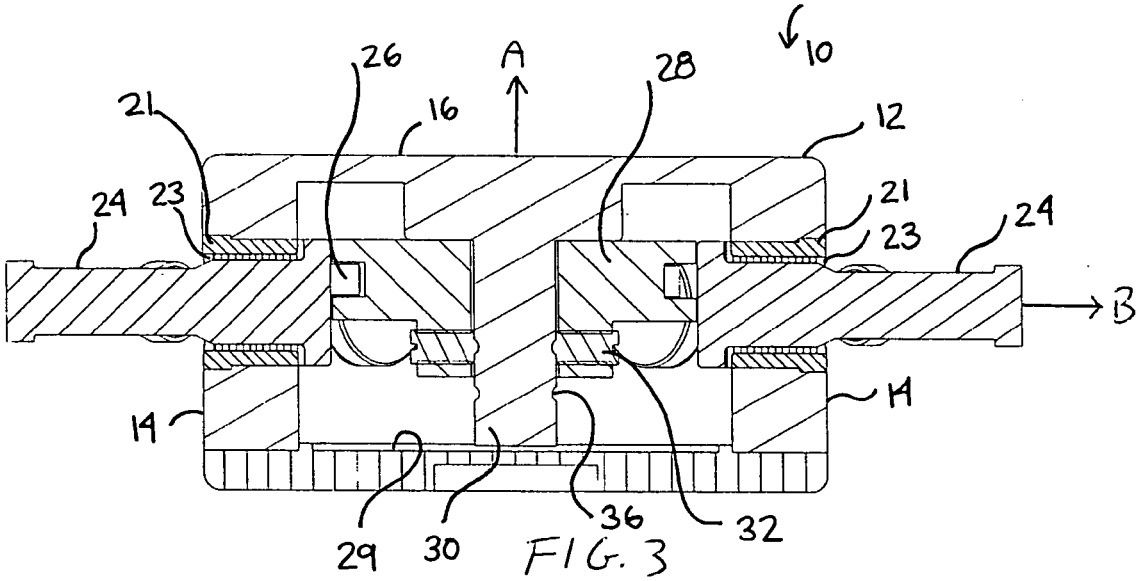
FIG. 3 is a cross-section through the variable pitch fan of FIG. 1, with the fan blades in a reverse thrust position, typically corresponding to blowing of air through a radiator away from an engine.
Figure 4:
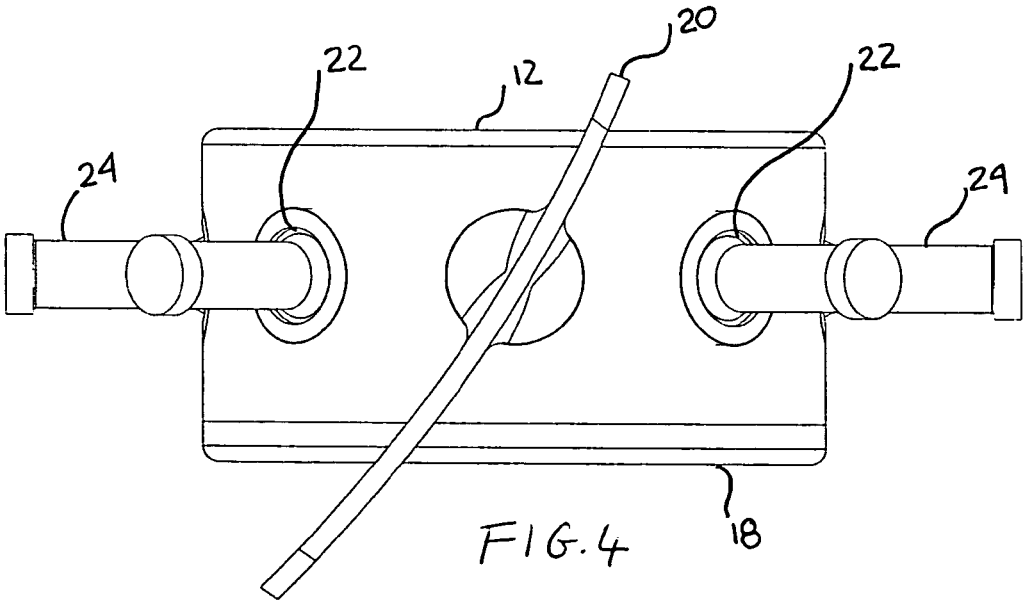
FIG. 4 is a side-view of the variable pitch fan of FIG. 1 with the blades in the reverse thrust position.
Figure 5:
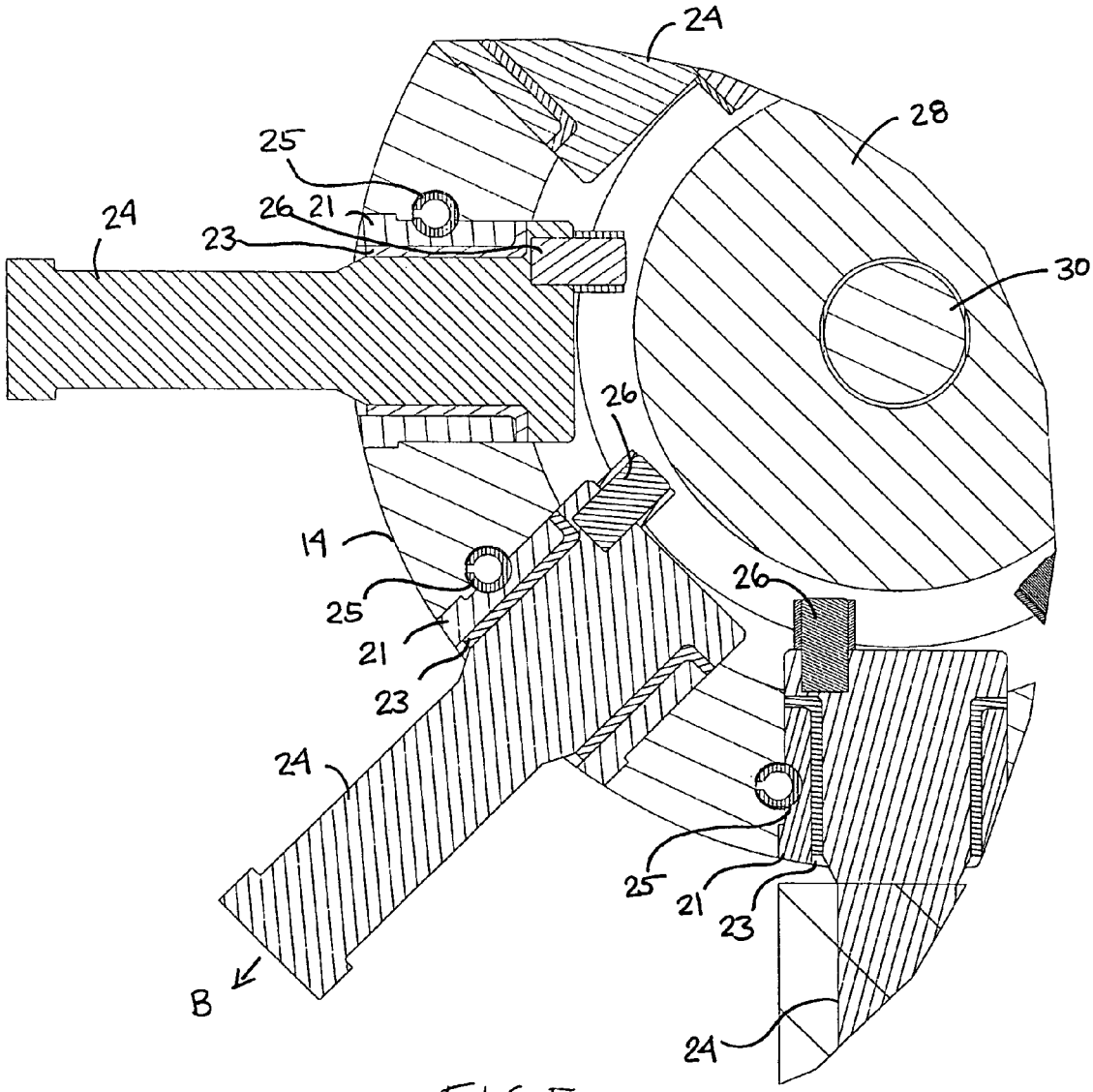
FIG. 5 is a section through the variable pitch fan of FIG. 1.

Referring to FIGS. 1-5, a manually actuated variable pitch fan 10 includes a fan hub 12 having a hub axis A and a peripheral wall 14. The peripheral wall 14 may be conveniently made integral with a first end plate 16, and capped with a second end plate 18. Blades 20 extend outward from the fan hub 12. One blade 20 is shown in each of FIGS. 2 and 4, but there will be multiple blades 20 around the fan, for example 8 or 12. Each blade 20 is journalled in a corresponding opening 22 in the peripheral wall 14 for rotation about a blade axis B. Each blade 20 is rotatable about the corresponding blade axis B under manual pressure between a normal thrust position (FIGS. 1, 2) and a reverse thrust position (FIGS. 3, 4).

Each blade 20 has a blade shaft 24 that terminates inwardly inside the fan hub 12. For convenience, the blade shafts 24 only and not the blades 20 are shown in FIGS. 1 and 3. The blade 20 may be journalled in the peripheral wall by any of various suitable means, such as a sleeve 21 and bushing 23 as shown. The blades 20 may be made of plastic moulded directly onto the blade shafts 24, with the bushings 23 and sleeves 21 already in place on the blade shafts 24. After each blade 20 is formed, it may be inserted into the corresponding opening 22 in the peripheral wall 14 and secured in place with a pin 25 (see FIG. 5) inserted through an opening in the peripheral wall 14.

A coupler 26, for example a pin, protrudes from an inward portion of each blade shaft 24 and connects to openings in a ring 28 that is movable axially, in relation to fan axis A, along a central shaft 30. Each coupler 26 is eccentrically located, in relation to the corresponding blade axis B, on the inward portion of the corresponding blade shaft 24. The ring 28 is a linkage that interconnects all of the fan blades 20 through the couplers 26. When manual pressure is applied to one of the fan blades 20 to rotate the fan blade 20 about its blade axis B, the coupler 26 moves eccentrically around the blade axis B and causes an axial movement, in relation to fan axis A, of the ring 28. The axial movement of the ring 28 causes each other fan blade 20 that is connected by couplers 26 to the ring 28 to rotate about their respective blade axes B in like manner to the blade 20 that is subject to manual pressure. Axial movement of the ring 28 thus conveys rotation of one or more of the fan blades 20 under manual pressure into a corresponding rotation of the fan blades 20 that are interconnected by the ring 28 and couplers 26. Axial movement of the ring 28 is limited by stops 27 and 29. The limits of movement of the ring 28 may be defined by a spacer (not shown) or other suitable mechanism now known or hereafter developed and need not be shoulders on the fan hub 12.

The linkage need not be a ring, but may be any device that links or interconnects the blade shafts 24 so that the interconnected blade shafts 24 rotate simultaneously upon manual pressure being applied to one or more of the blades, to or other part of the linkage. Thus, manual rotation of one blade shaft rotates the other blades that are interconnected with the linkage. Preferably, a tactile signal is given when the blades are rotated into their end positions shown in FIGS. 1 and 3, corresponding respectively to the normal and reverse thrust positions. A sensor that responds to movement of the blades into the normal thrust position and the reverse thrust position may be formed of pins 32 with inwardly directed bumps 34 that engage, in the respective end positions, with indentation 36 (FIG. 1) or indentation 38 (FIG. 3). As one of the blades 20 is rotated into one of the respective end positions, the movement of the bumps 34 into the indentations 36 or 38 can be felt, thus generating a simple tactile signal indicating that the blades 20 are in their operational positions. In this embodiment, the pins 32 are not required to hold the blades 20 in their operational positions.

The end positions of the blades 20 are shown in FIGS. 2 and 4. Each blade has a feathered position that lies within the range of rotational motion about the respective blade axes B between the normal thrust position and the reverse thrust position. Thus, when the ring 28 is in mid-range between the stops 27 and 29, the blades 20 are in the feathered position. When a blade moves between end positions, it passes through the feathered position. Each fan blade 20 preferably has a concave face 40 that faces towards the respective thrust direction in each of the normal thrust position and the reverse thrust position. In this embodiment of FIGS. 1-5, during operation, forces on the fan blades due to the rotation of the fan hub about its fan axis A causes the blades 20 to bias towards one or other of the respective end positions of FIGS. 2 and 4, with any further rotation of the blades 20 being limited by stops 27 and 29 that prevent further axial movement of the ring 28. Hence, once the blades 20 have been set to one of the end positions by manual pressure, the blades 20 remain there during operation.

Figure 6:
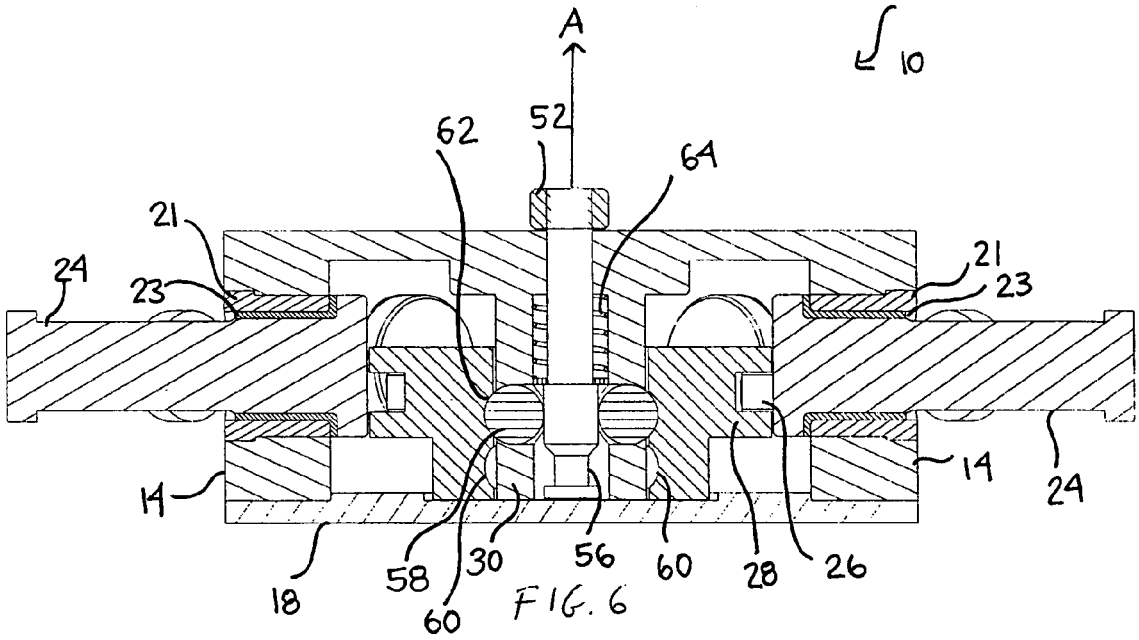
FIG. 6 is a cross-section through a variable pitch fan according to a second embodiment of the invention, with the fan blades in a normal thrust position, corresponding typically to sucking of air through a radiator of an engine.
Figure 7:
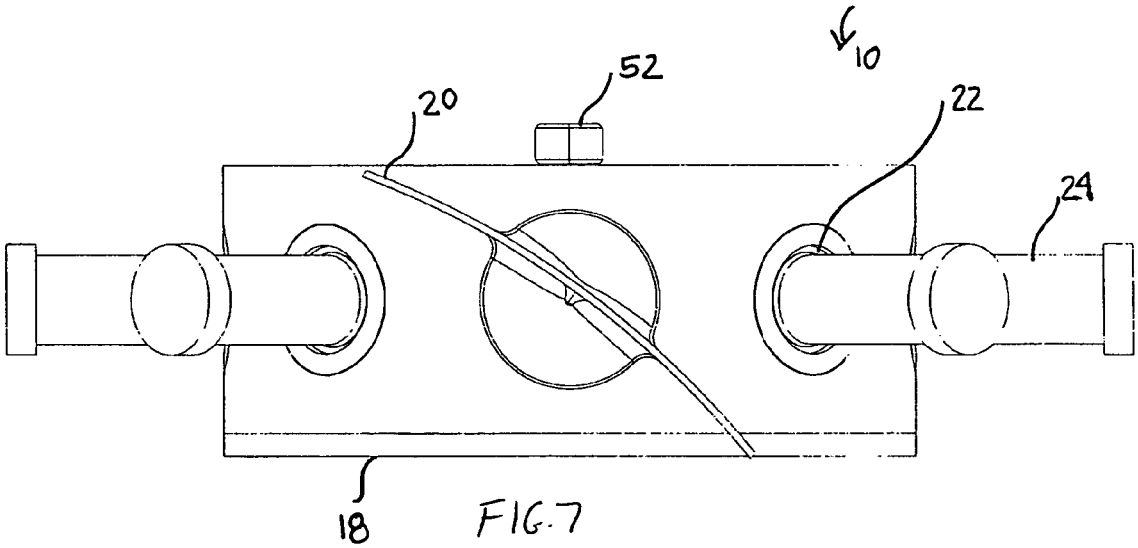
FIG. 7 is a side-view of the variable pitch fan of FIG. 6 with the blades in the normal thrust position.
Figure 8:
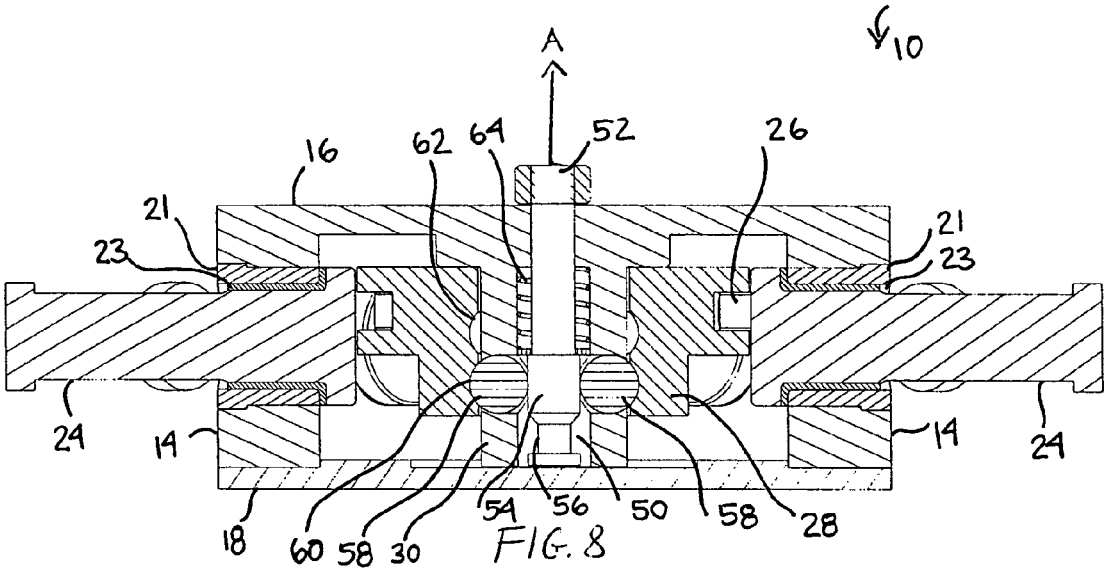
FIG. 8 is a cross-section through the variable pitch fan of FIG. 6, with the fan blades in a reverse thrust position, typically corresponding to blowing of air through a radiator away from an engine.
Figure 9:
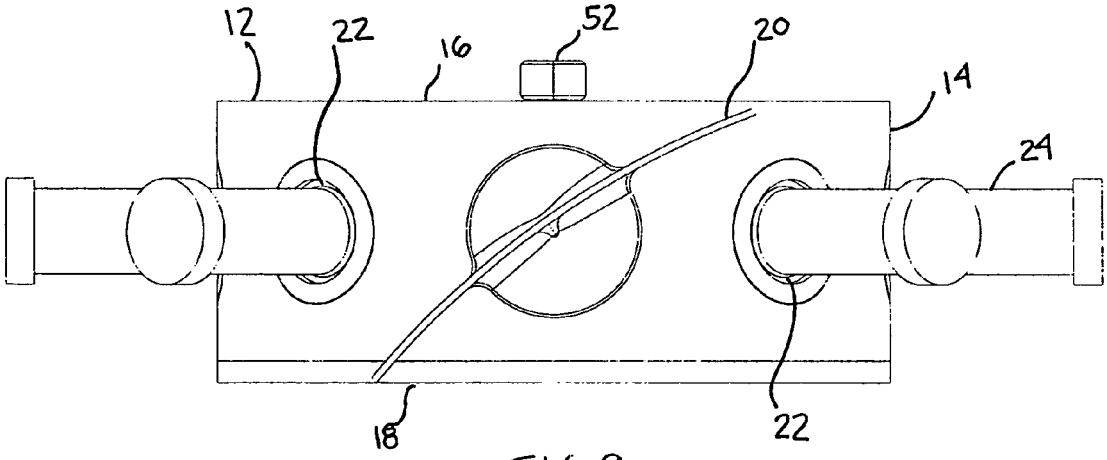
FIG. 9 is a side-view of the variable pitch fan of FIG. 6 with the blades in the reverse thrust position.

The embodiment of FIGS. 6-9 utilizes the same parts as the embodiment of FIGS. 1-5, except as described here. The end positions of the blades 20 in the second embodiment are shown in FIG. 7 (normal thrust position) and FIG. 9 (reverse thrust position). Each blade has a neutral position that lies within the range of rotational motion about the respective blade axes B between the normal thrust position and the reverse thrust position. Thus, when the ring 28 is in mid-range between the stops 27 and 29, the blades 20 are in the neutral position. When a blade moves between end positions, it passes through the neutral position. Each fan blade 20 has a concave face 40 that faces towards the thrust direction in the normal thrust position, but unlike with the first embodiment, the back convex side of the blade 20 faces the thrust direction in the reverse thrust position. In this embodiment of FIGS. 6-9, during operation, forces on the fan blades due to the rotation of the fan hub about its fan axis A causes the blades 20 to bias towards neutral. Hence, once the blades 20 have been set to one of the end positions by manual pressure, the blades 20 require a lock to make the blades remain in the end positions during operation.

The lock may be made of any of various suitable mechanisms. An example is described here, but a vast array of mechanisms could be used. In this case, the lock holds the ring 28 against axial movement in relation to axis A. The central shaft 30 in the embodiment of FIGS. 6-9 has an interior bore 50 through which extends a pin 52 having an enlarged diameter 54 at one location on the pin 52 and a reduced diameter 56 next to the enlarged diameter 54. Balls 58 are held in openings around the central shaft 30. Sockets 60, 62 are provided in the inside wall of the ring 28. The pin 52 is biased by spring 64 to place the enlarged diameter 54 against the balls 58. In this position, the balls 58 cannot move inward, and engagement of the sockets 60 and 62 as the case may be with the balls 58 prevent axial movement of the ring 28. In FIG. 6, the variable pitch fan is shown in the normal thrust position with the balls 58 engaged with sockets 60. To move the fan blades to the reverse thrust position, the pin 52 is pulled by hand axially outward compressing the spring 64 and leaving the balls 58 free to move into the opening produced by the reduced diameter 56. The blades 20 can then be rotated into the reverse thrust position by manual pressure on one or more of the fan blades 20, with a corresponding axial movement of the ring 28. The pin 52 may then be retracted to make the enlarged diameter 54 press the balls 58 into sockets 62, thus locking the fan blades in the reverse thrust position. The action of the spring 64 secures the lock until the pin is pulled outward.

The end positions of blade rotation about their own axes need not be normal and reverse, but could be varying degrees of blade pitch. By use of a suitable locking device with multiple stop positions, more than two pitch angles may be achieved, such as by providing the central shaft 30 with sockets or tactile sensors at more than two axial positions. However, the design with normal and reverse thrust positions has utility for example in summer months, when blowing from the engine compartment is desired, and in winter months, when sucking into the engine compartment is desired. With the manual adjustable pitch, a purge (blowing of air through the radiator), may be obtained whenever desired.

Figure 10:
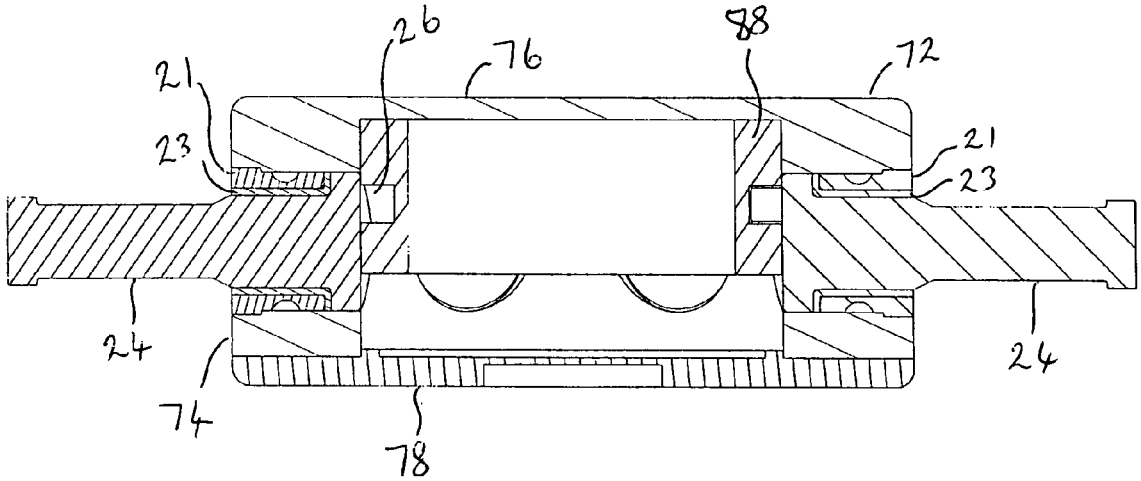
FIG. 10 is a cross-section through a variable pitch fan according to a third embodiment of the invention, with the fan blades in a normal thrust position, corresponding typically to sucking of air through a radiator of an engine.
Figure 11:
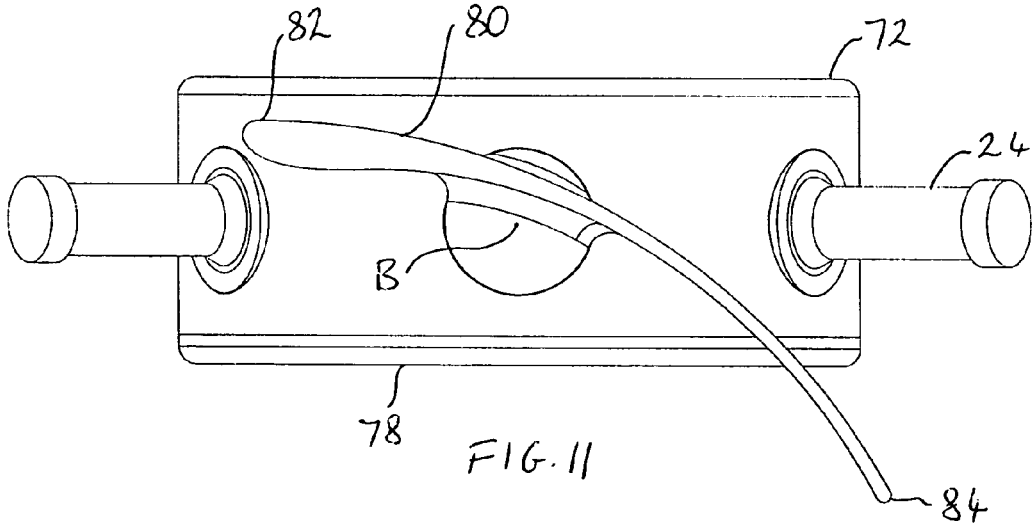
FIG. 11 is a side-view of the variable pitch fan of FIG. 10 with the blades in the normal thrust position.
Figure 12:
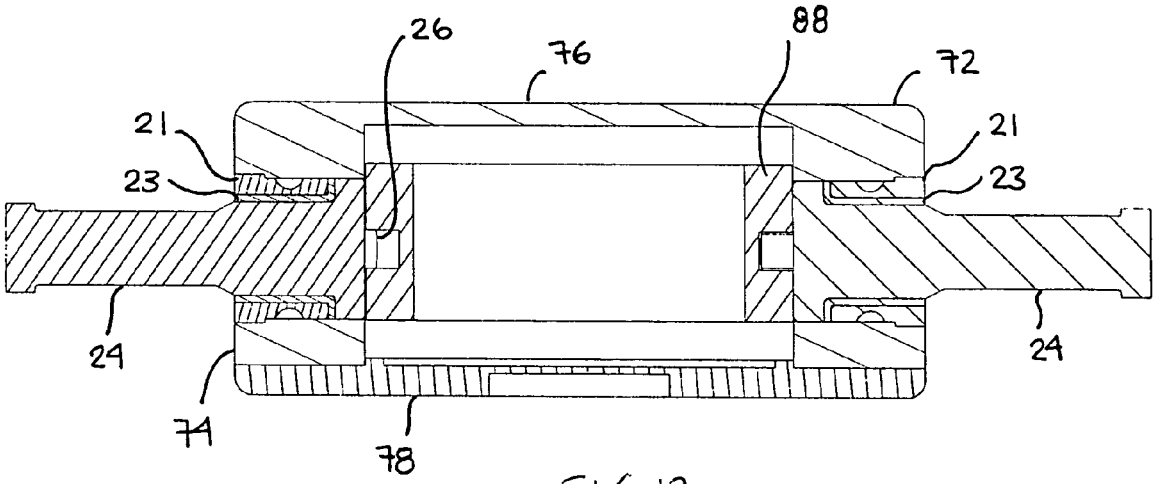
FIG. 12 is a cross-section through the variable pitch fan of FIG. 10 with the fan blades in the feathered position.
Figure 13:
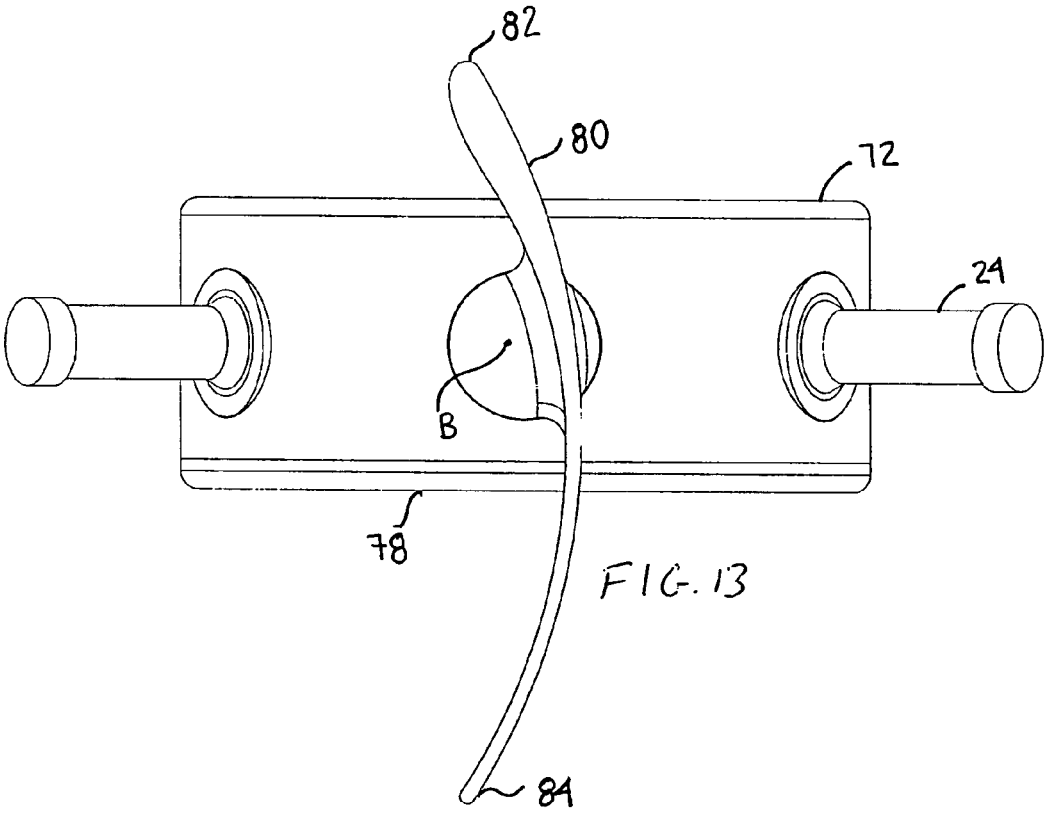
FIG. 13 is a side-view of the variable pitch fan of FIG. 10 with the blades in the feathered position.
Figure 14:
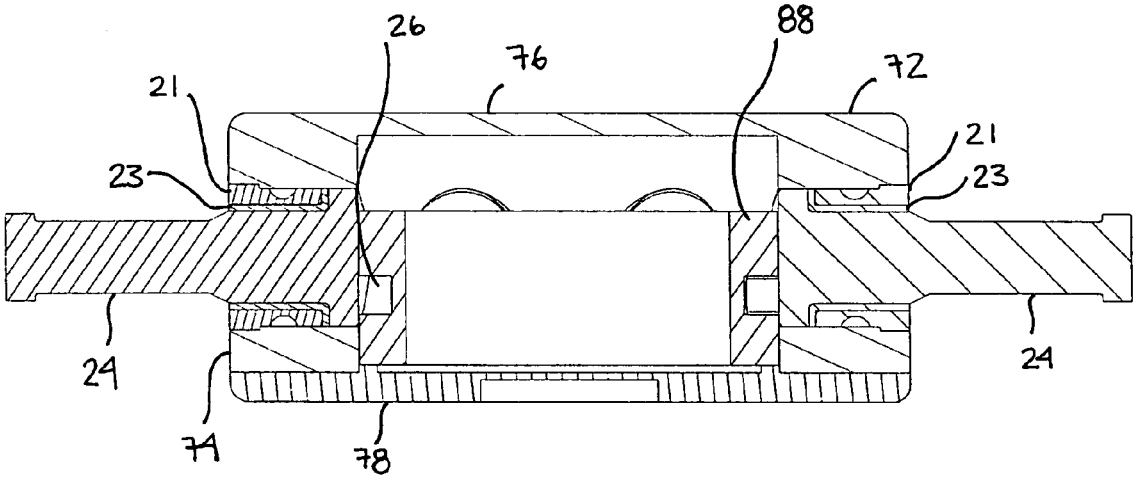
FIG. 14 is a cross-section through the variable pitch fan of FIG. 10, with the fan blades in a reverse thrust position, typically corresponding to blowing of air through a radiator away from an engine.
Figure 15:
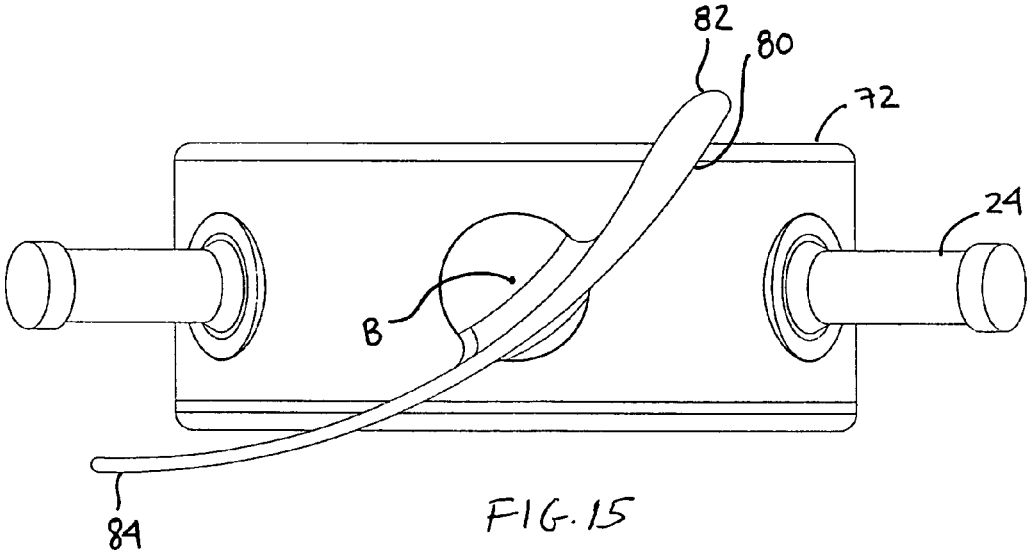
FIG. 15 is a side-view of the variable pitch fan of FIG. 10 with the blades in the reverse thrust position.

A further embodiment of a reversible pitch fan is shown in FIGS. 10-15. In these figures, the blade shafts 24, pin 26, bushing 23 and sleeve 21 have the same design as shown in FIGS. 1 and 2. In FIGS. 10 and 11, the fan hub 72, with side walls 74, front plate 76 and back plate 78, is designed to accommodate a ring 88 that slides axially within the inside diameter of the side walls 74 without the central shaft 30 of FIGS. 1 and 2. In this case, the ring 78 acts as the connecting linkage for the blades 80 (one shown in each of FIGS. 11, 13 and 15) that are moulded onto the blade shafts 24. As with the other designs, manual rotation of any one or more of the blades 80 or actuation of linkage 88 causes all blades 80 to rotate together as the ring 88 slides axially when the eccentric pins 26 rotate around the axes of the blade shafts 24. The ring 88 moves between the end positions shown respectively in FIG. 10 corresponding to normal (sucker) position and FIG. 14 corresponding to reverse (blower) position. Between the end positions, the ring 88 moves through the intermediate position shown in FIG. 12 in which the blades 80 are in the feathered position shown in FIG. 13. As with the embodiment of FIGS. 1-4, rotation of the fan blades 80 about the fan hub 72 during operation causes the blades 80 to be biased to one of the respective end positions, namely normal or reverse fan blade position.

The reversible or variable pitch fan 12, 72 typically is bolted to a fan drive (not shown) using the end plates 18, 78. It is preferable to have the mounting plate 18, 78 located as close as possible to the center line of the volume swept out by the fan blades 20, 80. In the model of FIGS. 1-9, the center line of the volume swept out by the fan blades 20 is coincident with the middle of the fan hub 12. In the model of FIGS. 10-15, the fan blades 80 extend more rearwardly at tip 84 than forwardly at tip 82. This feature of asymmetric construction of the fan blades of a manually shifted reversible pitch fan is known from the Huber fan. In the normal thrust position (sucker position), of FIG. 11, the mounting plate 78 is close to the center of the volume swept out by the fan blades 80, and a little further away in the reverse thrust position shown in FIG. 15. To achieve bias of the fan blades 80 to the respective end positions during rotation of the fan hub about the hub axis, it is desirable to have the center of gravity of the fan blades 80 as close as possible to the fan blade axis B. This is assisted by having shorter tip 82 thicker than longer tip 84, but differential thickness of tips 82, 84 is not a complete solution. Instability due to eccentric positioning of the center of gravity may cause problems with loss of positioning of the fan blades 80 during start up or stopping of the fan. This could be remedied by use of the lock mechanism of the design of FIGS. 6-9, or an inertial lock of the type used in seat belts of a motor vehicle. To remedy this potential problem by locating the center of gravity of the fan blade 80 at the blade axis B moves the chord connecting the tips 82, 84 away from the blade axis B. This movement of the chord away from the blade axis B tends to cause instability of the blade during rotation. Hence, the relative positions of the center of gravity and chord create a design trade-off that is a matter of choice for the designer if blades of the type shown in FIGS. 10-15 are to be used without a lock mechanism.

While the ring 28, 88 is shown as a suitable linkage between the blade shafts 24, other linkages could be used such as gears, or rigid links connected via joints to the pins 26. In addition, instead of rotating the fan blades using one or more of the fan blades, a lever, pin or pilot or other suitable mechanism could be attached directly to the ring 28, 88 or other linkage such that manual adjustment of the axial position of the linkage causes the blades 20, 80 to rotate simultaneously.

To change the blade angle, the operator of equipment having an engine simply gains access to the fan when the engine is not running and twists any one blade about its own axis to change the pitch of all blades attached to the hub. The manual fan also has application to other industrial uses where reversible air flow from a fan is desirable. The use of manual pitch change of the fan blades avoids the need for hydraulic, pneumatic or electrical pitch change mechanisms. The manually actuated variable or reverse pitch fan allows for a simple, low cost construction of an industrial fan.

Immaterial modifications may be made to the embodiments of the invention described here without departing from the invention.

What is claimed is:

1. A manually actuated reversible pitch fan, comprising:

a fan hub having a hub axis;

blades extending outward from the fan hub, the blades being journalled in the fan hub for manual rotation in relation to the fan hub between a normal thrust position and a reverse thrust position;

the blades being connected together by an actuation mechanism that causes the blades to rotate together between the normal thrust position and the reverse thrust position upon manual activation of the actuation mechanism;

the fan hub including stops that limit axial movements of the actuation mechanism and cause a corresponding limit on the rotation of the blades; and each of the fan hub, blades and the entire actuation mechanism being connected together for rotation about the hub axis.

2. The manually actuated reversible pitch fan of claim 1 in which the blades are oriented on the fan hub such that in moving between a normal thrust position and a reverse thrust position, the blades pass through a feathered position.

3. The manually actuated reversible pitch fan of claim 2 in which the fan hub has a direction of rotation in operation, each blade has a concave face, and in each of the normal thrust position and the reverse thrust position, the concave face faces in the direction of rotation of the fan hub.

4. The manually actuated reversible pitch fan of claim 3 in which the fan hub is provided with a sensor that responds to movement of the blades into the normal thrust position and the reverse thrust position.

5. The manually actuated reversible pitch fan of claim 4 in which the sensor includes a tactile signal generator responsive to movement of the blades into the normal thrust position and the reverse thrust position.

6. The manually actuated reversible pitch fan of claim 1 in which the actuation mechanism comprises an axially movable ring interconnected with couplers on the blades.

7. The manually actuated reversible pitch fan of claim 6 in which the couplers are pins, and the pins are received in openings in the axially movable ring.

8. The manually actuated reversible pitch fan of claim 7 in which:

each blade has a blade shaft; and the pin of each blade forms an inward extension of the blade shaft of the blade.

9. The manually actuated reversible pitch fan of claim 1 in which the blades are oriented on the fan hub such that in moving between a normal thrust position and a reverse thrust position, the blades pass through a neutral position.

10. The manually actuated reversible pitch fan of claim 9 in which the actuation mechanism comprises an axially movable ring interconnected with couplers on the blades, the axially movable ring being lockable in the normal thrust position and in the reverse thrust position.

11. The manually actuated reversible pitch fan of claim 10 in which the fan hub is provided with a sensor that responds to movement of the blades into the normal thrust position and the reverse thrust position.

12. The manually actuated reversible pitch fan of claim 11 in which the sensor includes a tactile signal generator responsive to movement of the blades into the normal thrust position and the reverse thrust position.

13. The manually actuated reversible pitch fan of claim 10 in which the couplers are pins, and the pins are received in openings in the axially movable ring.

14. The manually actuated reversible pitch fan of claim 13 in which:

each blade has a blade shaft; and the pin of each blade forms an inward extension of the blade shaft of the blade.

15. A manually actuated variable pitch fan, comprising:

a fan hub having a hub axis and a peripheral wall;

blades extending outward from the fan hub, each blade being journalled in an opening in the peripheral wall for rotation about a blade axis, each blade being rotatable about the blade axis under manual pressure between respective end positions in which the fan blades remain during operation;

each blade having a blade shaft, each blade shaft terminating inwardly inside the fan hub and having a coupler on the blade shaft inside the fan hub;

an actuation mechanism comprising a linkage movable axially inside the fan hub under manual pressure conveyed to the linkage, the linkage interconnecting the couplers on the fan blades to cause simultaneous rotation of the fan blades under manual pressure;

the fan hub including stops that limit axial movements of the linkage and cause a corresponding limit on the rotation of the blades; and each of the fan hub, the blades and the entire actuation mechanism being connected together for rotation about the hub axis.

16. The manually actuated variable pitch fan of claim 15 in which the linkage is operable by manual rotation of one or more of the fan blades about a fan blade axis.

17. The manually actuated variable pitch fan of claim 15 in which the respective end positions correspond to a normal thrust position and a reverse thrust position.

18. The manually actuated variable pitch fan of claim 17 in which the linkage comprises a ring.

19. The manually actuated variable pitch fan of claim 18 in which the couplers are pins received in openings spaced circumferentially around the ring.

20. The manually actuated variable pitch fan of claim 17 in which the fan hub is provided with a sensor that responds to movement of the blades into the normal thrust position and the reverse thrust position.

21. The manually actuated variable pitch fan of claim 20 in which the sensor includes a tactile signal generator responsive to movement of the fan blades into the normal thrust position and the reverse thrust position.

22. The manually actuated variable pitch fan of claim 17 in which each blade has a feathered position and a range of rotational motion between the normal thrust position and the reverse thrust position that includes the feathered position.

23. The manually actuated variable pitch fan of claim 22 in which each fan blade has a concave face that faces towards the respective thrust direction in each of the normal thrust position and the reverse thrust position.

24. The manually actuated variable pitch fan of claim 17 in which each blade has a neutral position and a range of rotational motion between the normal thrust position and the reverse thrust position that includes the neutral position.

25. The manually actuated variable pitch fan of claim 24 further comprising a lock on the linkage, the lock being lockable to secure the linkage against axial movement when the linkage is in the normal thrust position and when the linkage is in the reverse thrust position.

26. The manually actuated variable pitch fan of claim 25 in which each fan blade has a concave face that faces towards the thrust direction in the normal thrust position and away from the thrust direction in the reverse thrust position.

* * * * *